US010049620B2

(12) United States Patent
Shirouzu

(10) Patent No.: US 10,049,620 B2
(45) Date of Patent: Aug. 14, 2018

(54) DISPLAY DEVICE AND METHOD FOR CONTROLLING THE SAME

(71) Applicant: JOLED INC., Tokyo (JP)

(72) Inventor: Hiroshi Shirouzu, Shiga (JP)

(73) Assignee: JOLED INC., Tokyo (JP)

( * ) Notice: Subject to any disclaimer, the term of this patent is extended or adjusted under 35 U.S.C. 154(b) by 82 days.

(21) Appl. No.: 15/305,503

(22) PCT Filed: Dec. 22, 2014

(86) PCT No.: PCT/JP2014/006362

§ 371 (c)(1),
(2) Date: Oct. 20, 2016

(87) PCT Pub. No.: WO2015/162650

PCT Pub. Date: Oct. 29, 2015

(65) Prior Publication Data

US 2017/0047017 A1 Feb. 16, 2017

(30) Foreign Application Priority Data

Apr. 23, 2014 (JP) ..... 2014-089573

(51) Int. Cl.
*G09G 3/3291* (2016.01)
*G09G 3/325* (2016.01)
(Continued)

(52) U.S. Cl.
CPC ..... *G09G 3/3291* (2013.01); *G09G 3/325* (2013.01); *G09G 3/3233* (2013.01);
(Continued)

(58) Field of Classification Search
CPC .... G09G 3/3233; G09G 3/3291; G09G 3/325; G09G 3/3266
(Continued)

(56) References Cited

U.S. PATENT DOCUMENTS 8,089,477 B2 1/2012 Shirouzu et al.
2004/0100430 A1 5/2004 Fruehauf
(Continued)

FOREIGN PATENT DOCUMENTS

JP 2004-192000 7/2004
JP 2006-184848 7/2006
(Continued)

OTHER PUBLICATIONS

International Search Report (ISR), in International Pat. Appl. No. PCT/JP2014/006362, dated Mar. 31, 2015.

*Primary Examiner* — Koosha Sharifi-Tafreshi
(74) *Attorney, Agent, or Firm* — Greenblum & Bernstein, P.L.C.

(57) ABSTRACT

A display device includes: an organic electroluminescent element; a capacitor; a drive transistor; a data line; a test transistor which switches between conduction and non-conduction between the data line and an anode electrode of the organic electroluminescent element; a voltage generation unit which supplies the data line with a test voltage for measuring an anode voltage of the organic electroluminescent element; a current detection unit which detects a current through the test transistor when a test transistor is in a conducting state, while the voltage generation unit is applying the test voltage to the data line; a control unit which updates the voltage value of the test voltage, based on a direction of the current detected by the current detection unit, and causes the voltage generation unit to output the updated test voltage.

6 Claims, 8 Drawing Sheets

(51) Int. Cl.
*G09G 3/3266* (2016.01)
*G09G 3/3233* (2016.01)

(52) U.S. Cl.
CPC ... *G09G 3/3266* (2013.01); *G09G 2300/0842* (2013.01); *G09G 2300/0861* (2013.01); *G09G 2310/08* (2013.01); *G09G 2320/0233* (2013.01); *G09G 2320/0252* (2013.01); *G09G 2320/0295* (2013.01); *G09G 2320/043* (2013.01); *G09G 2320/045* (2013.01)

(58) Field of Classification Search
USPC ..... 345/76
See application file for complete search history.

(56) References Cited

U.S. PATENT DOCUMENTS

| | | | | |
|---|---|---|---|---|
| 2004/0108518 | A1* | 6/2004 | Jo | G09G 3/006 257/200 |
| 2006/0139261 | A1 | 6/2006 | Choi et al. | |
| 2009/0027374 | A1 | 1/2009 | Kohno et al. | |
| 2010/0103082 | A1 | 4/2010 | Levey et al. | |
| 2010/0245331 | A1* | 9/2010 | Shirouzu | G09G 3/3233 345/212 |

FOREIGN PATENT DOCUMENTS

| | | |
|---|---|---|
| JP | 2009-025742 | 2/2009 |
| JP | 2012-507041 | 3/2012 |
| WO | 2010/001594 | 1/2010 |

* cited by examiner

DISPLAY DEVICE AND METHOD FOR CONTROLLING THE SAME

TECHNICAL FIELD

The present disclosure: relates to a display device and a method for controlling the same.

BACKGROUND ART

A display device (organic electroluminescent display) which uses organic electroluminescent elements (OLED: organic light emitting diodes) is known as an image display device that uses current-driven light-emitting elements. The organic electroluminescent display has advantages of good viewing angle characteristics and low power consumption, and thus is thought to be a promising candidate as a next-generation flat panel display (FPD).

The organic electroluminescent display includes scanning lines and data lines, and selection transistors at intersections of the scanning lines and data lines, the selection transistors each connected to a capacitor. An organic electroluminescent display which turns on a selection transistor to write a signal voltage carried by a data line to a capacitor and uses a drive transistor connected to the capacitor to drive the organic electroluminescent element is referred to as an active matrix organic electroluminescent display. A problem with the active matrix organic electroluminescent display is luminance variations due to variations in characteristics of the drive transistors and the organic electroluminescent elements, in which the organic electroluminescent elements included in pixels differ in luminance even if the same signal voltage is applied to the organic electroluminescent elements.

As a conventional method for correcting luminance variations across an organic electroluminescent display, a method is disclosed which corrects variations in characteristics of the drive transistors and the organic electroluminescent elements by measuring an anode voltage of the organic electroluminescent element for each pixel and correcting a signal voltage based on the measured anode voltage.

For example, according to a display device and a method for controlling the same disclosed in Patent Literature 1, conductive line included in a pixel circuit which includes the organic electroluminescent element is pre-charged and then an anode voltage of the organic electroluminescent element is measured. If the anode voltage measured after the pre-charging is unstable, pre-charging conditions are reconfigured and the conductive line is pre-charged. Then, the anode voltage is measured again. This allows circuit element characteristics to be measured quickly and accurately.

CITATION LIST

Patent Literature

[Patent Literature 1] International Publication WO2010/001594

SUMMARY OF INVENTION

Technical Problem

However, according to the method for controlling the display device disclosed in Patent Literature 1, the conductive line is pre-charged to stabilize a detection voltage carried by the conductive line, and then the detection voltage reflective of the anode voltage is measured. In other words, the detection voltage carried by the conductive line is not measured until the detection voltage converges to the steady state. Consequently, it takes time for the detection voltage carried by the conductive line to converge to the steady state.

The present invention is made in view of the above problems and an object of the present invention is to provide a display device and a method for controlling the same which allow electrical characteristics of circuit elements to be detected quickly.

Solution to Problems

In order to solve the above problems, a display device according to one aspect of the present invention includes: a light-emitting element which emits light as a current flows through the light-emitting element; a capacitor; a drive transistor which passes to the light-emitting element a current dependent on a voltage held at the capacitor; a voltage detection line; a switching element which switches between conduction and non-conduction between the voltage detection line and one electrode of the light-emitting element; a voltage generation unit configured to supply the voltage detection line with a test voltage for measuring a voltage of the one electrode of the light-emitting element; a current detection unit configured to detect a current through the switching element when the switching element is in a conducting state, while the voltage generation unit is applying the test voltage to the voltage detection line; and a control unit configured to update a voltage value of the test voltage, based on a direction of the current detected by the current detection unit, and cause the voltage generation unit to output the updated test voltage.

Advantageous Effects of Invention

According to the display device and the method for controlling the same of the present invention, a magnitude relationship between a test voltage applied to a voltage detection line and a voltage of a light-emitting element is instantly determined from a direction of current through a path connecting the voltage detection line and the light-emitting element. Then, the test voltage is updated based on the determined direction of the current. For that reason, the test voltage is updated without waiting for the voltage of the voltage detection line to converge, thereby allowing quick measurement of the electrical characteristics of the circuit elements.

DESCRIPTION OF EMBODIMENTS

Hereinafter, embodiments of a display device and a method for controlling the same are described, with reference to the accompanying drawings. The embodiments described below are each merely one example of the present disclosure. Thus, values, shapes, materials, components, and arrangement and connection between the components, steps, and the order of the steps shown in the following embodiments are merely by way of illustration and not intended to limit the present invention. Therefore, among the components in the embodiments below, components not recited in any one of the independent claims defining the most generic part of the inventive concept of the present invention are described as arbitrary components.

The figures are schematic views and do not necessarily illustrate the present invention precisely. In the figures, the same reference sign is used to refer to substantially the same configuration, and duplicate description is omitted or simplified.

[Embodiment]

[1. Basic Configuration of Display Device]

Figure 1:
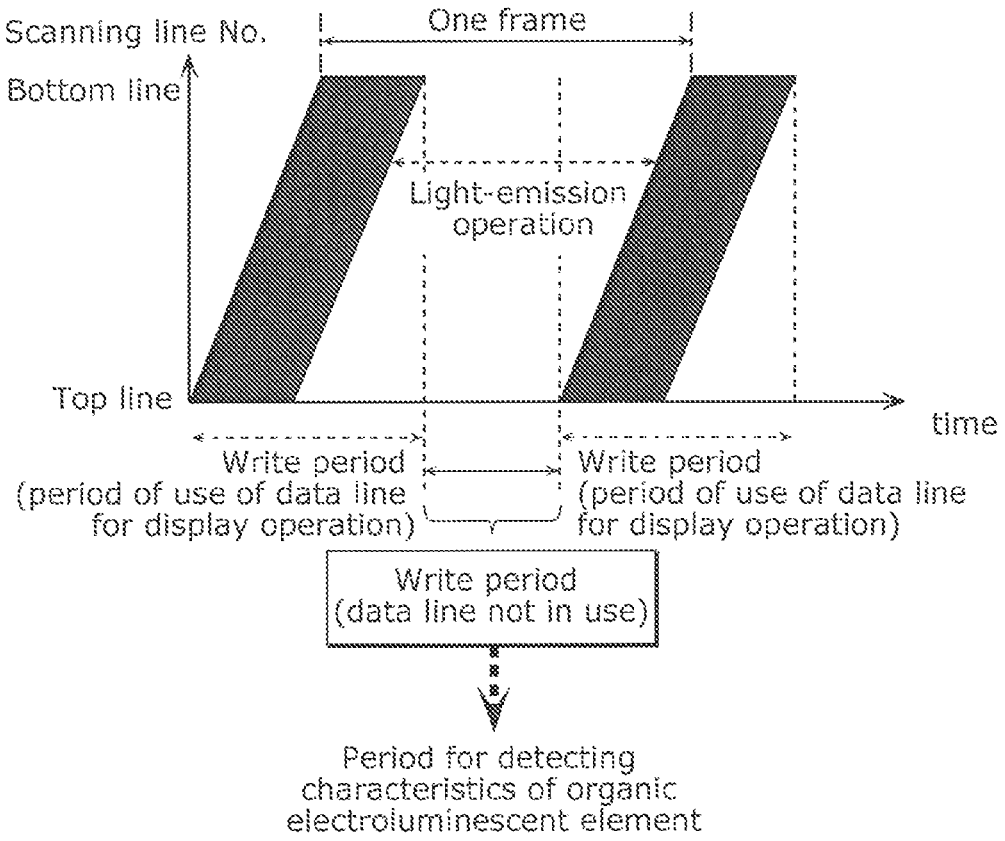
FIG. 1 is a state transition diagram of a display unit included in a general active matrix display device.

FIG. 1 is a state transition diagram of a display unit included in a general active matrix display device. The figure illustrates a write period and non-write period for each pixel row (line) in a certain pixel column. Pixel rows are indicated on the vertical axis and elapsed time is indicated on the horizontal axis. The write period, as used herein, refers to a period of time in which the data line is in use for supplying a signal voltage to each pixel. During the write period, the signal voltage is written to a pixel row-by-row. In a pixel circuit included in the display device, voltage is held at a capacitor and voltage is applied to the gate of a drive transistor simultaneously in the write period. Thus, light emission operation is carried out subsequent to the write operation.

In order for a conventional display device to accurately measure current-voltage characteristic of an aged organic electroluminescent element, because the pixel circuit has great parasitic capacitance, a long charging time is required to read a voltage of an organic electroluminescent element after a current is passed through the organic electroluminescent element. For this reason, the conventional display device cannot test a current-voltage characteristic during the write period and light-emission period as illustrated in FIG. 1, requiring a time period for testing the current-voltage characteristic separate from the write period and light-emission period.

According to the display device and the method for controlling the same of the present embodiment, current-voltage characteristic of the organic electroluminescent element can be tested making use of a non-write period in which the data line is not in use. As a result, the need for a separate time period, from the non-write period, for calculating current-voltage characteristic of the organic electroluminescent element is eliminated, thereby achieving video signal correction promptly accommodating the organic electroluminescent element characteristics which degrade due to change in the organic electroluminescent element over time.

The following describes, with reference to the accompanying drawings, that the display device according to the embodiment of the present invention achieves quick and accurate detection of the current-voltage characteristic of the organic electroluminescent element even during the non-write period.

Figure 2:
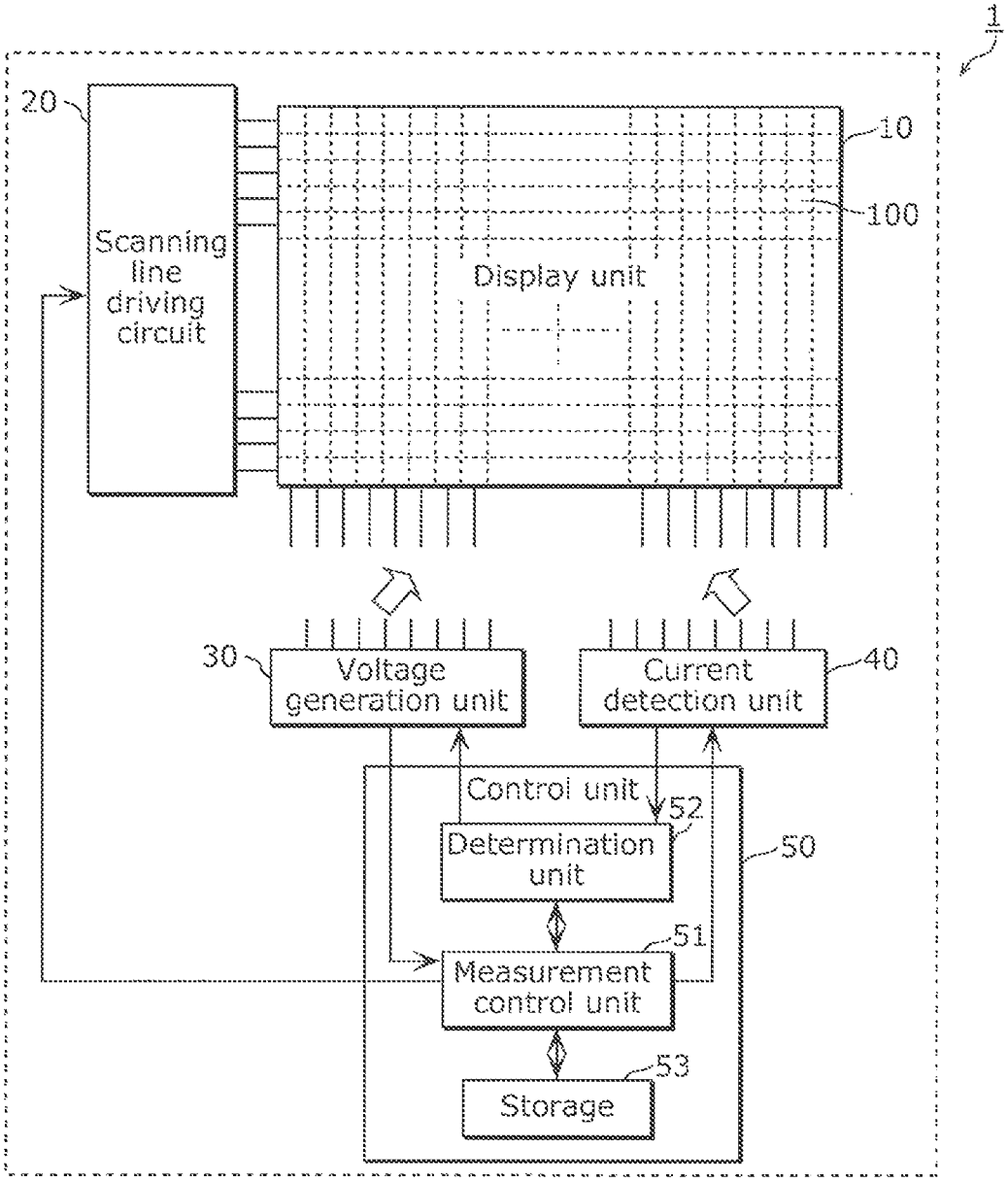
FIG. 2 is a functional block diagram of a display device according to an embodiment.

FIG. 2 is a functional block diagram of the display device according to the embodiment. In the figure, a display device 1 includes a display unit 10, a scanning line driving circuit 20, a voltage generation unit 30, a current detection unit 40, and a control unit 50. The display unit 10 includes pixels 100 arranged in rows and columns. The control unit 50 includes a measurement control unit 51, a determination unit 52, and a storage 53.

[2. Pixel Configuration]

Figure 3:
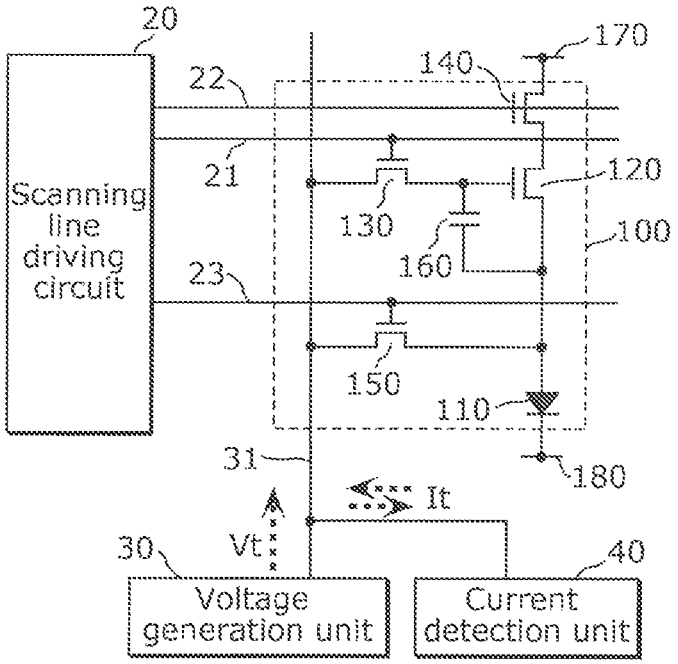
FIG. 3 is a diagram showing circuit configuration of a pixel included in a display unit according to the embodiment and connection between the pixel and peripheral circuits.

FIG. 3 is a diagram showing circuit configuration of a pixel included in the display unit according to the embodiment and connection between the pixel and peripheral circuits. The pixel 100 in the figure includes an organic electroluminescent element 110, a drive transistor 120, a selection transistor 130, a switch transistor 140, a test transistor 150, and a capacitor 160. A positive supply line 170, a negative supply line 180, a data line 31, a scanning line 21, and control lines 22 and 23 are connected to the pixel 100. The pixel 100 is also connected to the scanning line driving circuit 20 via the scanning line 21 and the control lines 22 and 23, and connected to the voltage generation unit 30 and the current detection unit 40 via the data line 31.

The organic electroluminescent element 110 serves as a light-emitting element, and emits light dependent on a drive current provided by the drive transistor 120. The organic electroluminescent element 110 has a cathode electrode, which is the other electrode, connected to the negative supply line 180. The cathode electrode is typically grounded.

The drive transistor 120 has the gate electrode connected to the data line 31 via the selection transistor 130, the source electrode connected to the anode electrode, which is one electrode of the organic electroluminescent element 110, and the drain electrode connected to the source electrode of the switch transistor 140.

The selection transistor 130 has the gate electrode connected to the scanning line 21, the drain electrode connected to the data line 31, and the source electrode connected to one electrode of the capacitor 160. The selection transistor 130 switches between the conduction and the non-conduction between the data line 31 and the capacitor 160.

The switch transistor 140 has the gate electrode connected to the control line 22, and the drain electrode connected to the positive supply line 170. The switch transistor 140 is disposed along a path of current which flows through the drive transistor 120 and the organic electroluminescent element 110, and switches between passing the current and not passing the current to the drive transistor 120 and the organic electroluminescent element 110.

The capacitor 160 has the one electrode connected to the gate of the drive transistor 120 and the other electrode connected to the source electrode of the drive transistor 120. The capacitor 160 is supplied with a signal voltage from the voltage generation unit 30 via the data line 31 and the selection transistor 130 and a voltage corresponding to the signal voltage is held at the capacitor 160.

The test transistor 150 has the gate electrode connected to the control line 23, the drain electrode connected to the data line 31, and the source electrode connected to the anode electrode of the organic electroluminescent element 110. The test transistor 150 is a switching element which switches between conduction and non-conduction between the data line 31 and the anode electrode of the organic electroluminescent element 110.

The data line 31 is disposed for each pixel column and connected to the pixels 100 belonging to the pixel column. The data line 31 carries the signal voltage output from the voltage generation unit 30 to each pixel in the pixel column during the write period. Moreover, the data line 31 is a voltage detection line which carries to the test transistor 150 a test voltage for detecting an anode voltage of the organic electroluminescent element 110 during the light-emission period.

The scanning line 21 is disposed for each pixel row and connected to the pixels 100 belonging to the pixel row. The scanning line 21 carries a scanning signal output from the scanning line driving circuit 20 to each pixel in the pixel row.

The control lines 22 and 23 are disposed for each pixel row and connected to the pixels 100 belonging to the pixel row. The control lines 22 and 23 carry control signals output from the scanning line driving circuit 20 to each pixel in the pixel row.

[3. Element Voltage Measurement Configuration]

Next, configuration of peripheral circuits of the pixel 100 illustrated in FIG. 2 is described.

The scanning line driving circuit 20 is connected to the scanning line 21, and the control lines 22 and 23. The scanning line driving circuit 20 controls a voltage level of the scanning line 21, a voltage level of the control line 22, and a voltage level of the control line 23, thereby respectively controlling the conduction and non-conduction of the selection transistor 130, the conduction and non-conduction of the switch transistor 140, and the conduction and non-conduction of the test transistor 150 included in the pixel 100.

The voltage generation unit 30 is connected to the data line 31 and serves as a data line driving circuit which supplies the data line 31 with the signal voltage reflective of an external video signal during the write period. The voltage generation unit 30 also supplies the data line 31 with the test voltage for detecting the anode voltage of the organic electroluminescent element 110 during the light-emission period.

The test voltage, as used herein, refers to a voltage which is applied to the data line 31 during the light-emission period in order to accurately and quickly track a state of degradation of the organic electroluminescent element 110 over time. The current detection unit 40 detects a direction of current through the test transistor 150 connecting the data line 31 and the organic electroluminescent element 110 to compare the test voltage applied to the data line 31 and a voltage value of the anode voltage of the organic electroluminescent element 110. The control unit 50 updates the test voltage, based on the direction of the current through the test transistor 150. If a rate of change of the test voltage is less than or equal to a predetermined value, the control unit 50 determines the test voltage as measured anode voltage of the organic electroluminescent element 110. This allows the state of degradation of the organic electroluminescent element 110 over time to be accurately and quickly tracked.

It should be noted that the voltage generation unit 30 is, typically, a data driver integrated circuit, and the arrangement that outputs the test voltage may be provided separate from the data driver integrated circuit.

The current detection unit 40 is connected to the data line 31. In the light-emission period, the current detection unit 40 detects the current through the test transistor 150 when the test transistor 150 is in the conducting state while the voltage generation unit 30 is applying the test voltage to the data line 31.

It should be noted that the current detection unit 40 includes galvanometers as many as the data lines 31, and one of the galvanometers measures the current through the test transistor 150 and the data line 31 included in the pixel 100 belonging to one pixel row. Alternatively, the current detection unit 40 may include a multiplexer which switches the data lines 31, and a number of galvanometers less than the number of data lines 31. This reduces the number of galvanometers required for the measurement of the anode voltage of the organic electroluminescent element 110, and thereby peripheral area saving of the display unit 10 and a reduction of the part count are achieved.

The measurement control unit 51 controls when to place each transistor illustrated in FIG. 3 into the conducting state and the non-conducting state, and when to supply the test voltage from the voltage generation unit 30 to the data line 31, and when to cause the current detection unit 40 to detect the current through the test transistor 150.

The determination unit 52 updates the voltage value of the test voltage, based on a direction of the current detected by the current detection unit 40, and causes the voltage generation unit 30 to output the updated test voltage. Specifically, if the direction of the current detected by the current detection unit 40 is the direction from the data line 31 toward the anode electrode of the organic electroluminescent element 110, the determination unit 52 decreases the test voltage. On the other hand, if the direction of the current detected by the current detection unit 40 is the direction from the anode electrode of the organic electroluminescent element 110 toward the data line 31, the determination unit 52 increases the test voltage. In other words, the determination unit 52 quickly determines whether the anode potential of the organic electroluminescent element 110 is less than or greater than the potential of the data line 31 by measuring a current that flows through the test transistor 150 at the instance the test transistor 150 is made conduct. Moreover, if the rate of change of the test voltage changes to be equal to or below a threshold, the determination unit 52 determines the test voltage as the measured anode voltage of the organic electroluminescent element 110. Stated differently, the determination unit 52 quickly converges the test voltage, output from the voltage generation unit 30, to the anode voltage of the organic electroluminescent element 110, based on the direction of the current through the test transistor 150.

The control unit 50 stores into the storage 53 the test voltage determined by the determination unit 52 as the measured anode voltage of the organic electroluminescent element 110, as the anode voltage of the organic electroluminescent element 110.

The control unit 50 further reads the anode voltage of the organic electroluminescent element 110 stored in the storage 53, corrects the external video signal data, based on the anode voltage, and outputs the video signal data to the voltage generation unit 30 which serves as the data line driving circuit. This corrects non-uniformity of the efficiency of light emission of the organic electroluminescent elements 110 each included in pixel 100, thereby reducing the luminance variations.

In the conventional display device, a data line is precharged to stabilize a detection voltage carried by the data line, and then the detection voltage reflective of the anode voltage of the organic electroluminescent element is measured. In other words, the detection voltage carried by the data line is not read until the detection voltage converges to the steady state. Consequently, it takes time for the voltage carried by the data line to converge to the steady state. Further, the greater the circuit size of the display device, that is, the longer the data line is or the greater the number of peripheral pixel circuit elements, the greater the time constant for interconnect along with parasitic capacitance. This results in increasing the time for the data line voltage to converge to the steady state.

In contrast, according to the display device 1 of the present embodiment, the magnitude relationship between the data line 31 having the test voltage applied and the anode voltage of the organic electroluminescent element 110 is instantly determined by the direction of the current through the test transistor 150 connected between the data line 31 and the organic electroluminescent element 110. Then, the test voltage is updated based on the detected direction of the current. For that reason, the test voltage is updated without waiting for the voltage carried by the data line 31 to converge. This allows the electrical characteristics of the circuit elements to be measured quickly.

Moreover, the test voltage output from the voltage generation unit 30 is updated based on the direction of the current through the test transistor 150, until the rate of change of the test voltage changes to be equal to or below the threshold. This allows accurate and quick measurement of the electrical characteristics of the organic electroluminescent element 110.

Further, the voltage of the organic electroluminescent element 110 can be read making use of the non-write period in which the data line 31 is not in use. For that reason, the need for a separate time period, from the non-write period, for calculating voltage characteristics of the organic electroluminescent element is eliminated, thereby quickly obtaining characteristics of the organic electroluminescent element 110 which degrade due to change in the organic electroluminescent element over time. Further, since the anode voltage of the organic electroluminescent element 110 is measured by using the data line 31 which carries the signal voltage, without separately providing a voltage detection line for measuring the anode voltage of the organic electroluminescent element 110, area saving of the pixel circuit and securing of the light-emission area are achieved.

For that reason, video signal correction that promptly accommodates the characteristics of the organic electroluminescent element 110, which degrade due to change in the organic electroluminescent element over time, is achieved, and thereby the display unevenness is suppressed.

[4. Method for Controlling Display Device]

Next, a method for controlling the display device 1 according to the embodiment is described. The control method allows detection of the characteristics of the organic electroluminescent element 110. The method for controlling the display device according to the present embodiment includes (a) resetting the pixel circuit; (b) writing the signal voltage reflective of the video signal data; (c) causing the organic electroluminescent element 110 to emit light according to the signal voltage; (d) quickly measuring the anode voltage of the organic electroluminescent element 110 in the light-emission period, and (e) inserting black.

Figure 4:
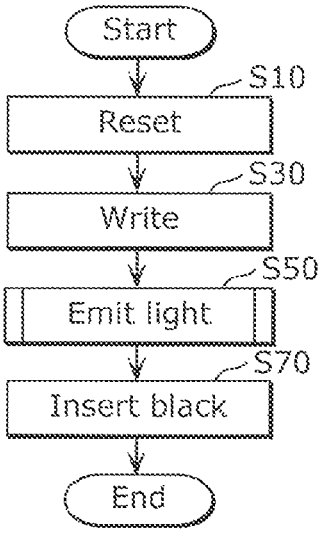
FIG. 4 is a flowchart illustrating operation of the display device according to the embodiment.
Figure 5:
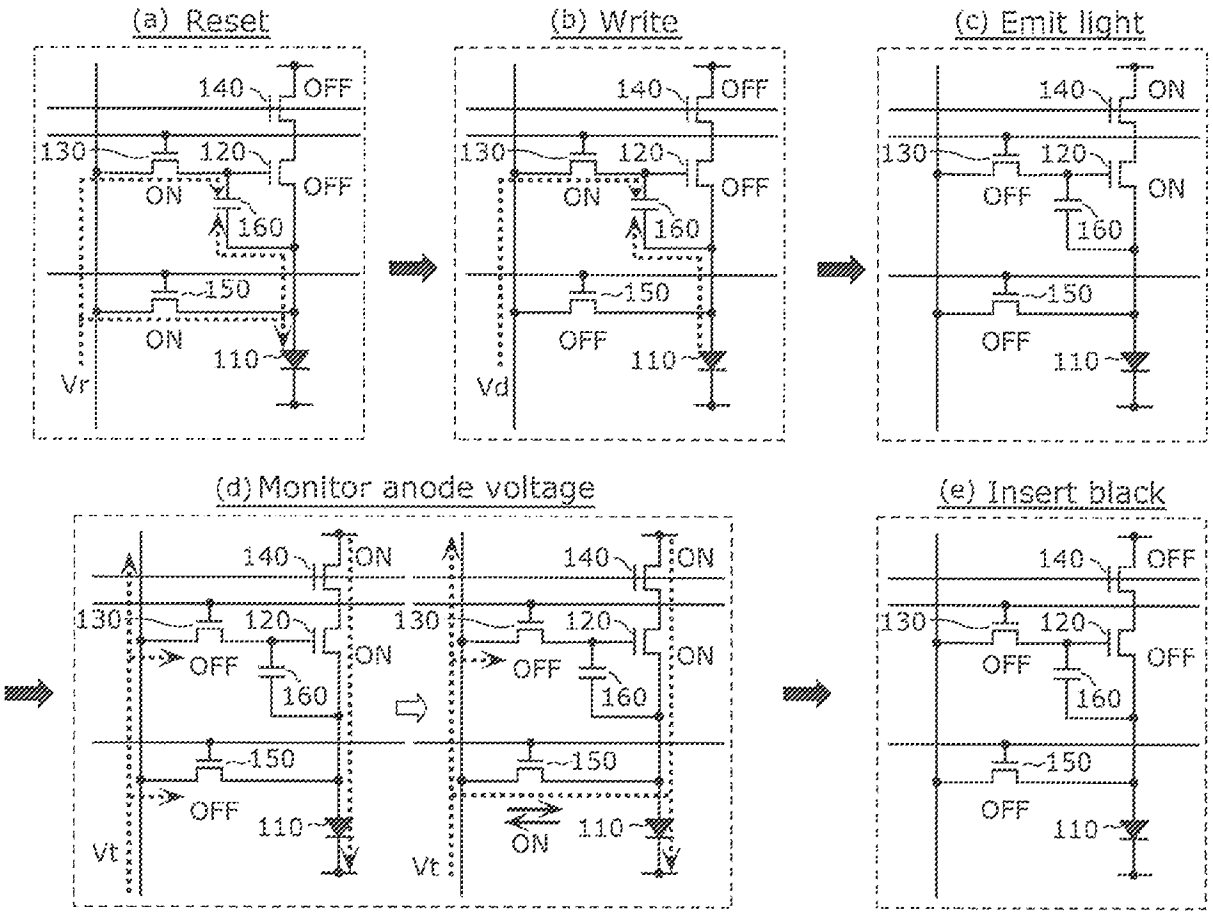
FIG. 5 is a state transition diagram of a pixel circuit according to the embodiment.

FIG. 4 is an operational flowchart illustrating the display device according to the embodiment. FIG. 5 is a state transition diagram of the pixel circuit according to the embodiment.

First, the control unit 50 resets the pixel circuit (S10). Specifically, as illustrated in (a) of FIG. 5, the measurement control unit 51 places the selection transistor 130 and the test transistor 150 into the on-state, and the switch transistor 140 into the off-state. The measurement control unit 51 also causes the voltage generation unit 30 to output a reset voltage Vr to the data line 31. This resets the anode voltage of the organic electroluminescent element 110, and pixel circuit elements including the capacitor 160 and the data line 31.

Next, the control unit 50 writes the signal voltage (S30). Specifically, as illustrated in (b) of FIG. 5, the measurement control unit 51 places the selection transistor 130 into the on-state, and the switch transistor 140 and the test transistor 150 into the off-state. The measurement control unit 51 also causes the voltage generation unit 30 to output a signal voltage Vd reflective of the video signal data to the data line 31. This causes the voltage corresponding to the signal voltage Vd to be held at the capacitor 160. In other words, the signal voltage Vd is written to the pixel 100.

Next, the control unit 50 causes the organic electroluminescent element 110 to emit light (S50). Specifically, as illustrated in (c) of FIG. 5, the measurement control unit 51 places the selection transistor 130 and the test transistor 150 into the off-state, and the switch transistor 140 into the on-state. This causes the drive transistor 120 to pass through the organic electroluminescent element 110 a drive current corresponding to the voltage held at the capacitor 160. The organic electroluminescent element 110 emits light at luminance dependent on the drive current.

Next, the control unit 50 measures the anode voltage of the organic electroluminescent element 110 in the light-emission period. In the following, a step of measuring the anode voltage, which is an inventive subject matter of the present invention, is described with reference to FIGS. 6 and 7.

Figure 6:
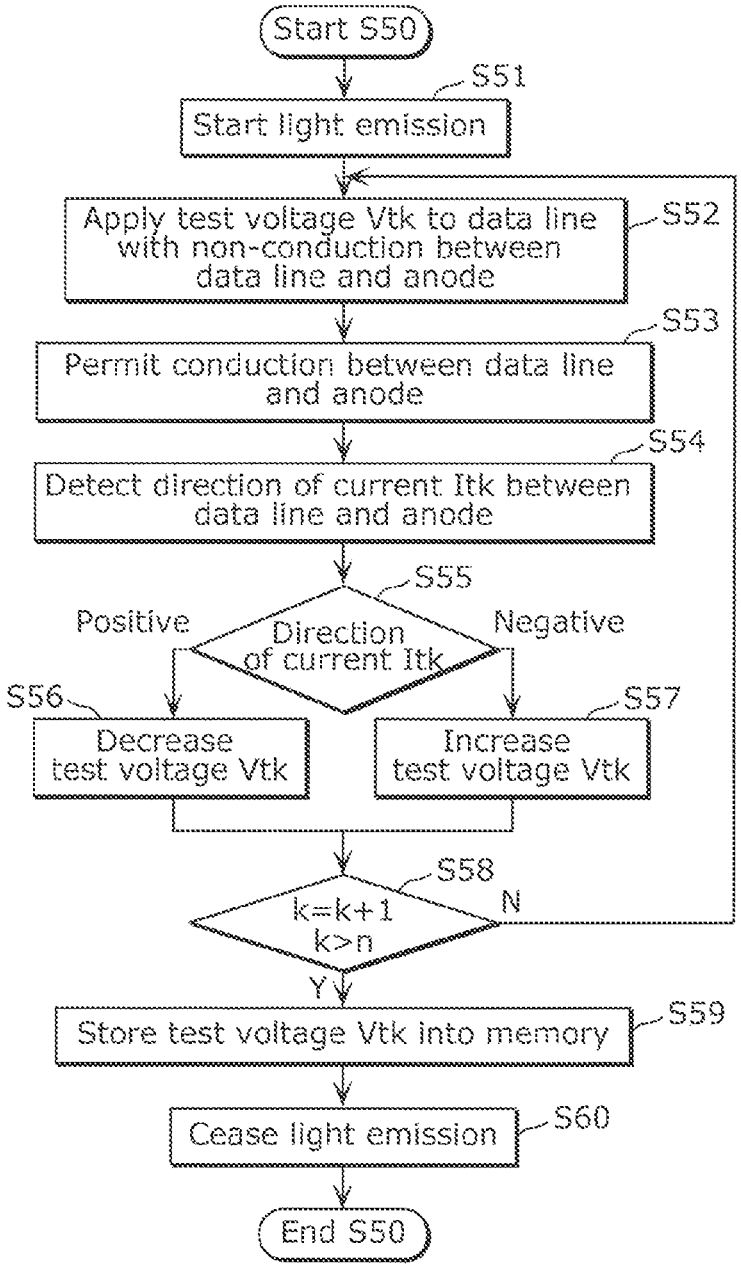
FIG. 6 is an operational flowchart illustrating procedure of measuring an anode voltage of an organic electroluminescent element according to the embodiment.
Figure 7:
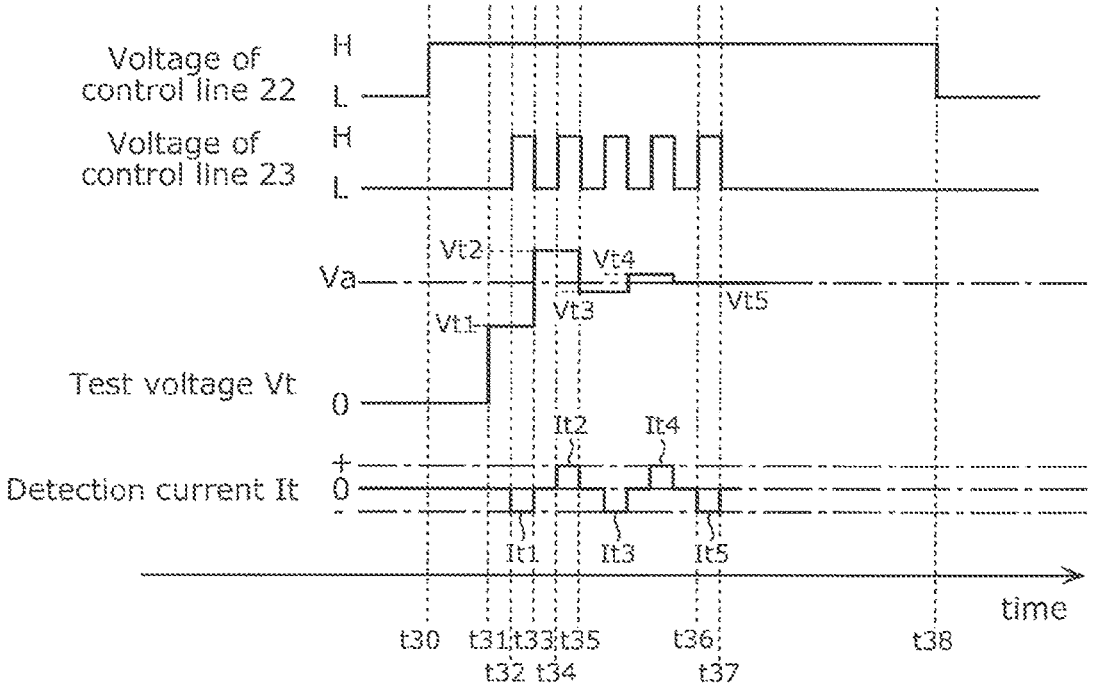
FIG. 7 is an example of a timing diagram illustrating the procedure of measuring the anode voltage of the organic electroluminescent element according to the embodiment.

FIG. 6 is an operational flowchart illustrating the procedure of measuring the anode voltage of the organic electroluminescent element according to the embodiment. FIG. 7 is an example of a timing diagram illustrating the procedure of measuring the anode voltage of the organic electroluminescent element according to the embodiment. FIG. 6 specifically illustrates the measurement operation of the anode voltage of the control unit 50 in the light-emission period discussed above. FIG. 7 shows, from top to bottom, voltage of the control line 22, voltage of the control line 23, test voltage Vt, and detection current It.

First, as illustrated in FIGS. 6 and 7, at time t30, the measurement control unit 51 changes the control line 22 to high to place the switch transistor 140 into the on-state and cause the organic electroluminescent element 110 to start emitting light (S50 and S51). After this, in the light-emission period at t30 to t38, the measurement control unit 51 keeps the control line 22 high to keep the on-state of the switch transistor 140.

Next, at time t31, the measurement control unit 51 causes the voltage generation unit 30 to apply a test voltage Vt1 to the data line 31, while keeping the off-state of the selection transistor 130 and test transistor 150 (S52, the left figure in (d) of the FIG. 5).

Next, at time t32, the measurement control unit 51 changes the control line 23 to high to place the test transistor 150 into the on-state and permit conduction between the data line 31 and the anode electrode of the organic electroluminescent element 110 (S53, the right figure in (d) of FIG. 5).

Next, at the same time as or immediately after time t32, the measurement control unit 51 causes the current detection unit 40 to measure current through the test transistor 150. Here, if the potential of the data line 31 is higher than the anode potential of the organic electroluminescent element 110, a galvanometer included in the current detection unit 40 measures, for example, a positive current value (current flowing out from the current detection unit 40 into the data line 31). If the potential of the data line 31 is lower than the anode potential of the organic electroluminescent element 110, the galvanometer included in the current detection unit 40 measures, for example, a negative current value (current flowing out from the data line 31 into the current detection unit 40). The determination unit obtains the measurement data of the current value measured by the current detection unit 40, at which time the determination unit 52 detects a direction of the current through the test transistor 150 (S54).

In the present embodiment, as illustrated in FIG. 7, the current detection unit 40 measures the detection current It1 having a negative current value at times t32 and t33. Thus, the determination unit 52 determines the anode potential of the organic electroluminescent element 110 to be higher than the potential of the data line 31.

As a result of the determination of the direction of the detection current It1 (S55), if the determination unit 52 determines that the detection current It1 is flowing from the data line 31 toward the anode electrode (positive direction) of the organic electroluminescent element 110, the measurement control unit 51 causes the voltage generation unit 30 to generate a test voltage Vt2 which is the test voltage Vt1 having a reduced voltage value (S56 and S58). On the other hand, if the determination unit 52 determines that the detection current It1 is flowing from the anode electrode of the organic electroluminescent element 110 toward the data line 31 (negative direction), the measurement control unit 51 causes the voltage generation unit 30 to generate the test voltage Vt2 which is the test voltage Vt1 having an increased voltage value (S57 and S58).

The operations performed at steps S52 through S58 described above are repeated a predetermined number n of times.

Next, the measurement control unit 51 obtains from the voltage generation unit 30 the test voltage Vtn updated (n−1) times, and stores it as the measured anode voltage of the pixel 100 into the storage 53 (S59).

It should be noted that the series of operations: application of the test voltage Vt; measurement of the detection current It; and update of the test voltage Vt may be repeated the predetermined number n of times, and if the rate of change of the updated test voltage Vt is equal to or below the threshold, the test voltage may be ceased from being updated and the last updated test voltage Vt may be determined as the measured anode voltage of the organic electroluminescent element 110.

In the present embodiment, as illustrated in FIG. 7, at times t32 and t33, the detection current It1 is determined to be flowing in the negative direction, and the test voltage Vt2 is increased to be greater than the test voltage Vt1. The operations at and after time t33 are as follows: the test voltage Vt2 is applied (until time t35); a detection current It2 is greater than zero; a test voltage Vt3 (less than Vt2) is applied; a detection current It3 is less than zero; a test voltage Vt4 (greater than Vt3) is applied; a detection current It4 is greater than zero; and then a test voltage Vt5 (less than Vt4) is generated (n=5).

It should be noted that, in generating a test voltage Vt (k+1) based on a direction of a detection current itk, preferably, a binary search represented in Equation 1 below is used to calculate a test voltage Vtk (k is a natural number greater than or equal to 2):

$$\text{If } Itk \text{ is less than zero: } Vt(k+1)=Vtk+|Vtk-Vt(k-1)|/2$$

$$\text{If } Itk \text{ is greater than zero: } Vt(k+1)=Vtk-|Vtk-Vt(k-1)|/2$$

$$Vt0=Va\max, Vt1=Va\max/2 \qquad \text{(Equation 1)}$$

In Equation 1 above, Vamax denotes a maximum value of the anode voltage of the organic electroluminescent element 110. The determination of the test voltage Vt (k+1) by using the binary search requires a reduced number of updates of the test voltage for allowing the test voltage to quickly converge to the anode voltage of the organic electroluminescent element 110. In this case, if the voltage difference between the test voltages Vt (k+1) and Vtk is equal to or below a threshold, the test voltage may be ceased from being updated, and the test voltage Vt (k+1) may be determined as the measured anode voltage of the organic electroluminescent element 110.

Moreover, the use of the above binary search allows calculation of a convergence value of the test voltage Vt by digital signal processing. For example, in the case of repeatedly performing the operations of steps S52 through S58 n times, n-bit digital signal processing may be performed.

Next, at time t38, the measurement control unit 51 changes the control line 22 to low to place the switch transistor 140 into the off-state and cease the organic electroluminescent element 110 from emitting light (S60).

Returning to FIG. 4, the control unit 50 inserts black (S70). Specifically, as illustrated in (e) of FIG. 5, the measurement control unit 51 places the selection transistor 130, the switch transistor 140, and the test transistor 150 into the off-state. This causes the organic electroluminescent element 110 to emit no light. In other words, pixels belonging to a selected pixel row, or all pixels in the display unit 10 display black images.

According to the control method described above, the magnitude relationship between the test voltage and the anode voltage of the organic electroluminescent element 110 is instantly determined by the direction of the current through between the data line 31 and the organic electroluminescent element 110, rather than waiting for the voltage value of the data line 31 having great capacitance to converge to the steady state before measuring the anode voltage. Then, the test voltage is updated based on the determined direction of the current. For that reason, the test voltage is updated without waiting for the voltage carried by the data line 31 to converge, thereby allowing electrical characteristics of the organic electroluminescent element 110 to be measured quickly.

Moreover, the test voltage supplied to the data line 31 is updated based on the direction of the current through the test transistor 150, until a voltage difference between a (k+1)th test voltage and a kth test voltage is equal to or below the threshold, thereby allowing electrical characteristics of the organic electroluminescent element 110 to be measured accurately and quickly.

For that reason, video signal correction promptly accommodating the characteristics of the organic electroluminescent element 110, which degrade due to change in the organic electroluminescent element over time, is achieved, thereby suppressing display unevenness.

[5. Effects]

As described above, one aspect of the display device according to the present embodiment includes: the organic electroluminescent element 110 which emits light as a current flows through organic electroluminescent element 110; the capacitor 160; the drive transistor 120 which passes to organic electroluminescent element 110 a current dependent on a voltage held at the capacitor 160; a voltage detection line; the test transistor 150 which switches between conduction and non-conduction between the voltage detection line and an anode electrode of organic electroluminescent element 110; the voltage generation unit 30 which supplies the voltage detection line with a test voltage for measuring an anode voltage of organic electroluminescent element 110; the current detection unit 40 which detects a current through the test transistor 150 when the test transistor 150 is in a conducting state, while the voltage generation unit 30 is applying the test voltage to the voltage detection line; and the control unit 50 which updates a voltage value of the test voltage, based on a direction of the current detected by the current detection unit 40, and causes the voltage generation unit 30 to output the updated test voltage.

According to this configuration, the magnitude relationship between the voltage detection line having the test voltage applied and the anode voltage of the organic electroluminescent element 110 is instantly determined by the direction of the current through the test transistor 150 connected between the voltage detection line and the organic electroluminescent element 110. Then, the test voltage is updated based on the determined direction of current. For that reason, the test voltage is updated without waiting for the voltage carried by the voltage detection line to converge, thereby allowing electrical characteristics of pixel circuit elements to be measured quickly.

Moreover, the control unit 50 may include: the measurement control unit 51 which controls when to place the test transistor 150 into the conducting state and a non-conducting state; and the determination unit 52 which decreases the test voltage if the direction of the current detected by the current detection unit 40 is from the voltage detection line toward the anode electrode of the organic electroluminescent element 110, and increases the test voltage if the direction of the current detected by the current detection unit 40 is from the anode electrode toward the voltage detection line, and the determination unit 52 may determine the test voltage as the anode voltage of the organic electroluminescent element 110 if a rate of change of the test voltage is below or equal to a threshold.

This updates the test voltage, which is output from the voltage generation unit 30, based on the direction of the current through the test transistor 150, until the rate of change of the test voltage changes to be equal to or below the threshold, thereby allowing accurate and quick measurement of the electrical characteristics of the organic electroluminescent element 110

Moreover, the display device according to the present embodiment may further include: the selection transistor 130 which switches between conduction and non-conduction between the voltage detection line and the capacitor 160; and the switch transistor 140 which is disposed along a path of a current flowing toward the drive transistor 120 and the organic electroluminescent element 110, and switches between passing the current and not passing the current to the drive transistor 120 and the organic electroluminescent element 110, wherein the voltage detection line is the data line 31 which carries a signal voltage to be held at the capacitor 160, and in period for writing the signal voltage to the capacitor 160, the control unit 50 is places the selection transistor 130 into the conducting state and writes to the capacitor 160 the signal voltage carried by the voltage detection line, and in a period in which the organic electroluminescent element 110 is emitting light, the control unit 50 places the switch transistor 140 and the test transistor 150 into the conducting state and detects the direction of the current through the test transistor 150.

In order for a conventional display device to accurately measure current-voltage characteristic of an aged organic electroluminescent element, because the pixel circuit has great parasitic capacitance, a long charging time is required to read a voltage of an organic electroluminescent element after current is passed through the organic electroluminescent element. For this reason, the conventional display device cannot test the current-voltage characteristic during the write period and light-emission period, requiring a time period for testing the current-voltage characteristic separate from the write period and light-emission period. In contrast, according to the above configuration, the voltage of the organic electroluminescent element 110 can be tested making use of the non-write period in which the data line 31 is not in use. For that reason, the need for a separate time period, from the non-write period, for calculating the voltage characteristics of the organic electroluminescent element is eliminated, thereby quickly obtaining the organic electroluminescent element characteristics which degrade due to change in the organic electroluminescent element over time. Further, since the anode voltage of the organic electroluminescent element 110 is measured by using the data line 31 which carries the signal voltage, without separately providing a voltage detection line for measuring the anode voltage of the organic electroluminescent element 110, area saving of the pixel circuit and securing of the light-emission area are achieved.

Moreover, the display device according to the present embodiment may further include: pixels 100 disposed in rows and columns and each of which includes the organic electroluminescent element 110, the drive transistor 120, and the capacitor 160, wherein based on the test voltage determined, by the determination unit 52, as the anode voltage of the organic electroluminescent element 110, the control unit 50 corrects, for each of the pixels 100, the signal voltage which corresponds to the pixel 100 and is output to the data line.

This achieves video signal correction which promptly accommodates the characteristics of the organic electroluminescent element 110 which degrade due to change in the organic electroluminescent element over time, and thereby the display unevenness is suppressed.

Moreover, one aspect of a method for controlling the display device according to the present embodiment includes: supplying a voltage detection line with a test voltage for measuring an anode voltage of the organic electroluminescent element 110, while the voltage detection line and the anode electrode of the organic electroluminescent element 110 are in a non-conducting state; detecting a current through the test transistor 150 while the test voltage is being applied to the voltage detection line, after placing into a conducting state the test transistor 150 which switches between conduction and non-conduction between the voltage detection line and the anode electrode of the organic electroluminescent element 110; and updating a voltage value of the test voltage based on a direction of the current detected.

According to this configuration, the magnitude relationship between the test voltage and the anode voltage of the organic electroluminescent element 110 is instantly determined by the direction of the current through between the detection line and the organic electroluminescent element 110, rather than using a detection line having great capacitance and waiting for a voltage value of the detection line to converge to the steady state before measuring the anode voltage. Then, the test voltage is updated based on the determined direction of the current. For that reason, the test voltage is updated without waiting for the voltage value of the detection line to converge, thereby allowing the electrical characteristics of the organic electroluminescent element 110 to be measured quickly.

Moreover, the supplying, the detecting, and the updating may be repeated plural times in listed order, at kth supplying, a kth test voltage may be supplied to the voltage detection line, where k is a natural number greater than or equal to 2, at kth detecting, a kth current through the test transistor 150 may be detected, and at kth updating, a voltage value of the kth test voltage may be updated based on the direction of the current through the test transistor 150 and a (k+1)th test voltage may be generated, and if a voltage difference between the (k+1)th test voltage and the kth test voltage is equal to or below a predetermined value, the (k+1)th test voltage may be determined as the anode voltage of the organic electroluminescent element 110.

This updates the test voltage, which is supplied to the voltage detection line, based on the direction of the current through the test transistor 150, until the voltage difference between a (k+1)th test voltage and a kth test voltage is equal to or below the threshold. Thus, the electrical characteristics of the organic electroluminescent element 110 are allowed to be measured accurately and quickly.

(Other Embodiments)

While the embodiment has been described above, the display device and the method for controlling the same according to the present invention are not limited to the above embodiment. Other embodiments achieved by combining any of the components included in the above embodiment, variations obtained by various modifications to the above embodiment that may be conceived by a person skilled in the art without departing from the spirit of the present invention, and various devices which include the display device according to the present invention are included in the scope of the present invention.

For example, while the current detection unit 40 according to the above embodiment includes a galvanometer and the current through the test transistor 150 is detected by the galvanometer, the magnitude of the current need not be measured insofar as the current detection unit 40 includes a circuit which detects a direction of the current through the test transistor 150. In the above embodiment, the detection current It is small and thus, preferably, the direction of the detection current It is detected by a system using a charge amplifier as illustrated in FIG. 8.

Figure 8:
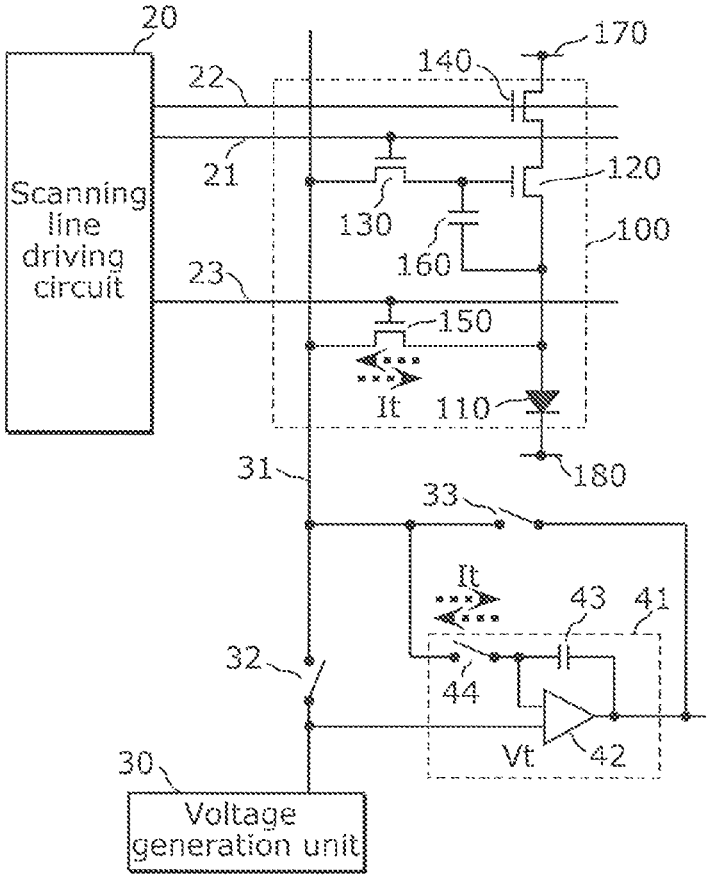
FIG. 8 is a configuration diagram of a display device, including circuit configuration of a current detection unit which measures a direction of current.

FIG. 8 is a configuration diagram of a display device, including circuit configuration of a current detection unit which measures a direction of current. The display device shown in the figure includes a current detection unit 41. The current detection unit 41 includes an inverting amplifier 42, a capacitor 43, and a switch 44. Further, switches 32 and 33 are disposed along a data line 31. The switch 32 switches between the conduction and the non-conduction between the data line 31 and the voltage generation unit 30. The switch 33 switches between the conduction and the non-conduction between an output terminal of the current detection unit 41 and the data line 31. The current detection unit 41 has an input terminal connected to the data line 31, and the output terminal connected to a determination unit 52 (not shown). The inverting amplifier 42 has a negative input terminal connected to the data line 31 via the switch 44, and further connected to the output terminal of the inverting amplifier 42 via the switch 33. The inverting amplifier 42 has a positive input terminal which receives a test voltage Vt from the voltage generation unit 30, and an output terminal connected to a determination unit 52 (not shown). The capacitor 43 has electrodes one of which is connected to the negative input terminal of the inverting amplifier 42 and the other of which is connected to the output terminal of the inverting amplifier 42.

In the circuit configuration, in the write period, initially, the switch 32 is placed in the on-state and the switches 33 and 44 are placed in the off-state. This causes the voltage generation unit 30 to write a signal voltage to a pixel 100 via the data line 31. Next, in the light-emission period, the switch 32 is placed in the off-state, and the switch 33 and 44 are placed in the on-state. This applies the test voltage Vt to the data line 31 via the current detection unit 41. Next, in the light-emission period, the test transistor 150 is placed in the off-state, the switch 32 is placed in the off-state, the switch 33 is placed in the off-state, and the switch 44 is placed in the on-state to be ready for detecting a direction of the current through the test transistor 150. Next, the test transistor 150 is placed in the on-state while keeping the off-state of the switch 32, the off-state of the switch 33, and the on-state of the switch 44. At this time, the capacitor 43 is charged or discharged by a detection current It through the test transistor 150, thereby applying a voltage corresponding to the detection current It to the negative input terminal of the inverting amplifier 42. This outputs a differential voltage between the voltage corresponding to the detection current It and the test voltage Vt applied to the positive input terminal of the inverting amplifier 42 to the output terminal of the inverting amplifier 42, at which time the polarity of the output voltage of the inverting amplifier 42 is reversed in accordance with the direction of the detection current It through the test transistor 150. In other words, the direction of the current through the test transistor 150 can be determined by detecting the polarity of the output voltage of the inverting amplifier 42.

Moreover, while the data line 31 is used as the voltage detection line to measure the anode voltage of the organic electroluminescent element 110 in the above embodiment, the voltage detection line may be provided separately from the data line 31. This allows the electrical characteristics of the organic electroluminescent element 110 to be quickly and accurately measured. In addition, since this separately provides a current-detection path for measuring the anode voltage, the current and the anode voltage are detected without effects of voltage drop caused by the selection transistor 130, thereby allowing the anode voltage to be measured further accurately.

Moreover, while the above embodiment has been described with reference to one example of the circuit configuration of the pixels included in the display device according to the present invention, the circuit configuration of the pixels 100 is not limited to the circuit configuration described above. For example, while the switch transistor 140, the drive transistor 120, and the organic electroluminescent element 110 are disposed in listed order between the positive supply line 170 and the negative supply line 180 in the above embodiment, these three elements may be disposed in a different order. In other words, the drain electrode and source electrode of the drive transistor, irrespective of whether the drive transistor is of n-type or p-type, and the anode electrode and cathode electrode of the organic electroluminescent element may be disposed along the current path between the positive supply line 170 and the negative supply line 180 in the display device according to the present invention and this is not limited by the order of placement of the drive transistor and the organic electroluminescent element. In this case, the cathode voltage of the organic electroluminescent element may be measured instead of the anode voltage, to compensate for change of the organic electroluminescent element over time.

Moreover, while the above embodiment described the configuration and method for quickly and accurately measuring the voltage characteristics of the organic electroluminescent element included in the display device, the method for controlling the display device according to the present invention yields the same advantageous effects when applied to the organic electroluminescent element for measuring current-voltage characteristics of circuit elements incorporated in the display device. In other words, the method for controlling the display device according to the present invention is applicable to a display device which includes: a test transistor for connecting a voltage detection line and predetermined nodes of the circuit elements; a voltage generation unit which applies a test voltage to the voltage detection line; and a current detection unit which detects a direction of current through the test transistor. In this case, the greater the circuit size of the display device, that is, the longer the voltage detection line for measuring current-voltage characteristics of the circuit elements or the greater the number of pixel circuit elements, the greater the advantageous effects of the present invention.

Moreover, the embodiment has been described with reference to n-type transistors each of which changes to the on-state when, for example, a voltage of the gate of the transistor changes to high. However, the display device according to the present invention yields advantageous effects same as in the above embodiment when the display device includes the selection transistor, the switch transistor, the test transistor, and the drive transistor that are configured of p-type transistors, and the polarities of the scanning line and Moreover, while the above embodiment is described assuming that the transistors serving as the drive transistor, switch transistor, test transistor, and selection transistor are each a field effect transistor (FET) that has the gate, source, and drain, the transistors may be bipolar transistors which have base, collector, and emitter. In this case also, the object of the present invention is achieved and the same advantageous effects are provided.

Moreover, the channels between the switch transistor, test transistor and selection transistor are unidirectional and thus the source electrode and drain electrode are named as such for ease of description. The source electrode and the drain electrode may be switched.

Moreover, the sequence of operations of the display device according to the present invention is not limited to the operations illustrated in FIGS. 4 and 5. For example, operation of correcting the threshold voltage and mobility of the drive transistor 120 may be added after the reset period and before the write period. The black insertion may be omitted.

Moreover, the light-emission operation may not be carried out row-by-row and all the organic electroluminescent elements 110 may emit light at once after completion of the write operation carried out row-by-row.

Moreover, the control unit and computing circuits included in the display device according to the above embodiment are implemented typically in LSI (large scale integration) which are integrated circuits. It should be noted that some of the control unit and computing circuits included in the display device according to the above embodiment can be integrated on the same substrate as the display unit 10. Moreover, the control unit and computing circuits may be implemented in dedicated circuits or general-purpose processors. Moreover, a field programmable gate array (FPGA) which is programmable after manufacturing the LSI, or a reconfigurable processor in which connection or settings of circuit cells within LSI is reconfigurable may be used.

Moreover, some of the functionalities of the scanning line driving circuit, data line driving circuit, control unit, and computing circuits included in the display device according to the above embodiment may be implemented by a processor, such as CPU, executing programs.

Moreover, while the display device 1 according to the above embodiments has been described with reference to the display device which includes the organic electroluminescent element, the present invention may be applied to display devices which include light-emitting elements such as inorganic electroluminescent elements, other than the organic electroluminescent element.

Figure 9:
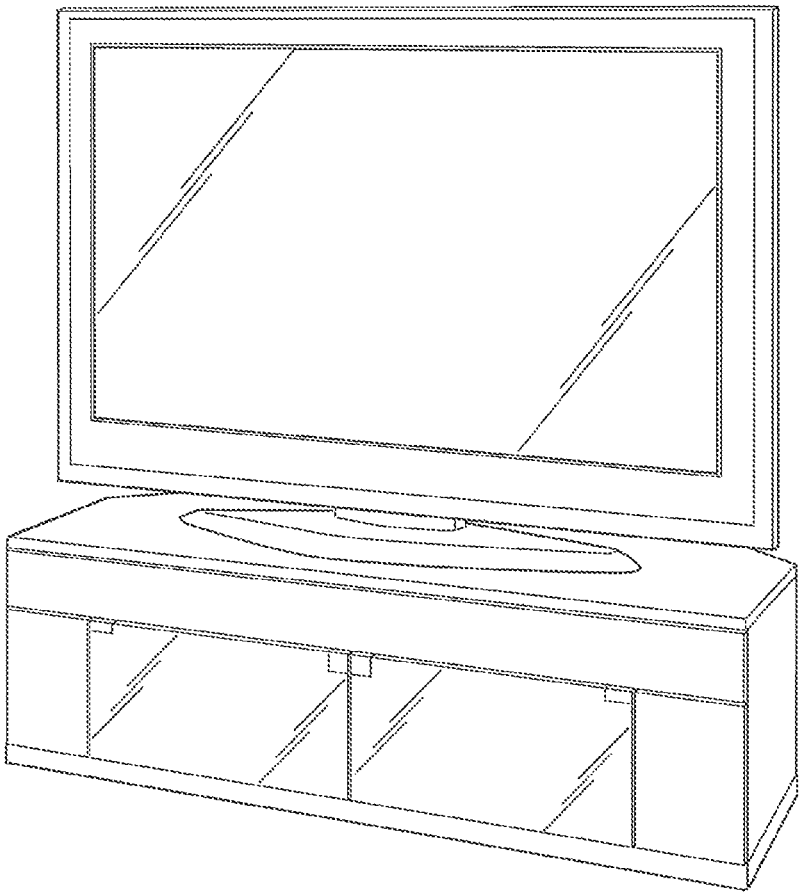
FIG. 9 is an external view of a thin, flat television which includes the display device according to the embodiment.

Moreover, for example, the display device and the method for controlling the same according to the present embodiment are incorporated in or used by a thin, flat television as illustrated in FIG. 9. A thin, flat television which includes a display having suppressed luminance variations of light-emitting elements is achieved by using the display device and the method for controlling the same according to the present embodiment.

INDUSTRIAL APPLICABILITY

The present invention useful, particularly, to active organic electroluminescent flat panel displays.

REFERENCE SIGNS LIST

1 display device
10 display unit
20 scanning line driving circuit
21 scanning line
22, 23 control line
30 voltage generation unit
31 data line
32, 33, 44 switch
40, 41 current detection unit
42 inverting amplifier
43, 160 capacitor
50 control unit
51 measurement control unit
52 determination unit
3 storage
100 pixel
110 organic electroluminescent element
120 drive transistor
130 selection transistor
140 switch transistor
150 test transistor
170 positive supply line
180 negative supply line

The invention claimed is:

1. A display device comprising:

a light-emitting element which emits light as a current flows through the light-emitting element;

a capacitor;

a drive transistor which passes to the light-emitting element a current dependent on a voltage held at the capacitor;

a voltage detection line;

a switching element which switches between conduction and non-conduction between the voltage detection line and one electrode of the light-emitting element;

a voltage generation circuit configured to supply the voltage detection line with a test voltage for measuring a voltage of the one electrode of the light-emitting element;

a current detection circuit configured to detect a current through the switching element when the switching element is in a conducting state, while the voltage generation circuit is applying the test voltage to the voltage detection line; and a control circuit configured to update a voltage value of the test voltage, based on a direction of the current detected by the current detection circuit, and cause the voltage generation circuit to output the updated test voltage.

2. The display device according to claim 1, wherein the control circuit includes:

a measurement control circuit configured to control when to place the switching element into the conducting state and a non-conducting state; and a determination circuit configured to decrease the test voltage if the direction of the current detected by the current detection circuit is from the voltage detection line toward the one electrode, and increase the test voltage if the direction of the current detected by the current detection circuit is from the one electrode toward the voltage detection line, and the determination circuit is configured to determine the test voltage as a measured voltage of the one electrode of the light-emitting element if a rate of change of the test voltage is below or equal to a threshold.

3. The display device according to claim 2, further comprising:

a selection transistor which switches between conduction and non-conduction between the voltage detection line and the capacitor; and a switch transistor which is disposed along a path of a current flowing toward the drive transistor and the light-emitting element, and switches between passing the current and not passing the current to the drive transistor and the light-emitting element, wherein the voltage detection line is a data line which carries a signal voltage to be held at the capacitor, and in a period for writing the signal voltage to the capacitor, the control circuit is configured to place the selection transistor into the conducting state and write to the capacitor the signal voltage carried by the voltage detection line, and in a period in which the light-emitting element is emitting light, the control circuit is configured to place the switch transistor and the switching element into the conducting state and detect the direction of the current through the switching element.

4. The display device according to claim 3, further comprising:

pixels disposed in rows and columns and each of which includes the light-emitting element, the drive transistor, and the capacitor, wherein based on the test voltage determined, by the determination circuit, as the measured voltage of the one electrode, the control circuit is configured to correct, for each of the pixels, the signal voltage which corresponds to the pixel and is output to the data line.

5. A method for controlling a display device which includes a light-emitting element which emits light as a current flows through the light-emitting element, a capacitor, and a drive transistor which passes to the light-emitting element a current dependent on a voltage held at the capacitor, the method comprising:

supplying a voltage detection line with a test voltage for measuring a voltage of the light-emitting element, while the voltage detection line and one electrode of the light-emitting element are in a non-conducting state;

detecting a current through a switching element while the test voltage is being applied to the voltage detection line, after placing into a conducting state the switching element which switches between conduction and non-conduction between the voltage detection line and the one electrode of the light-emitting element; and updating a voltage value of the test voltage based on a direction of the current detected.

6. The method according to claim 5, wherein the supplying, the detecting, and the updating are repeated plural times in listed order, at kth supplying, a kth test voltage is supplied to the voltage detection line, where k is a natural number greater than or equal to 2, at kth detecting, a kth current through the switching element is detected, and at kth updating, a voltage value of the kth test voltage is updated based on the direction of the current through the switching element and a (k+1)th test voltage is generated, and if a voltage difference between the (k+1)th test voltage and the kth test voltage is equal to or below a predetermined value, the (k+1)th test voltage is determined as a measured voltage of the one electrode of the light-emitting element.

* * * * *